United States Patent [19]

Farmer et al.

[11] 4,127,205

[45] Nov. 28, 1978

[54] LIFT TRUCK LOAD CLAMP FOR HANDLING PAPER ROLLS

[75] Inventors: Stanley E. Farmer, Troutdale; Harry F. Weinert, Portland; Donald M. Faust, Gresham, all of Oreg.

[73] Assignee: Cascade Corporation, Portland, Oreg.

[21] Appl. No.: 834,107

[22] Filed: Sep. 19, 1977

[51] Int. Cl.[2] ..... B66F 9/18

[52] U.S. Cl. ..... 214/652; 214/DIG. 4; 294/88; 294/106

[58] Field of Search ..... 214/147 G, 620, 650 R, 214/652, 653, 701 Q, DIG. 4; 294/88, 106

[56] References Cited

U.S. PATENT DOCUMENTS

| | | | |
|---|---|---|---|
| 2,814,396 | 11/1957 | Neale | 214/3 |
| 2,870,929 | 1/1959 | Quayle | 214/652 |
| 3,485,396 | 12/1969 | Lundquist | 214/147 G |
| 3,583,586 | 6/1971 | Burton | 214/652 |
| 3,896,957 | 7/1975 | Sinclair | 214/652 |

*Primary Examiner*—L. J. Paperner
*Attorney, Agent, or Firm*—Chernoff & Vilhauer

[57] ABSTRACT

A paper roll-handling clamp for lift trucks of the pivoted arm type capable of clamping a paper roll and shifting the position of the roll relative to the lift truck between a position of equal extension, wherein the forward ends of the clamp arms extend a substantially equal distance forwardly of the lift truck, and a position of unequal extension wherein the forward end of one clamp arm extends a greater distance forwardly than the forward end of the other clamp arm. The shifting movement of the clamp arms in unison occurs about a first transverse pivot axis, while the pivoting of the clamp arms with respect to one another to perform the clamping function occurs about a second transverse pivot axis located a spaced distance away from the first pivot axis and movable with respect thereto. The employment of the two separate pivot axes for the shifting function and the clamping function respectively enables the center of the paper roll to be placed very close to the longitudinal centerline of the lift truck and axis of rotation of the clamp when the clamp is in the position of equal extension, despite the fact that the first pivot axis about which the shifting movement occurs is offset transversely by a substantial distance from the truck centerline and axis of rotation, and enables the center of the roll to be offset advantageously from the centerline and axis of rotation in the unequal extension position.

11 Claims, 6 Drawing Figures

FIG. 3
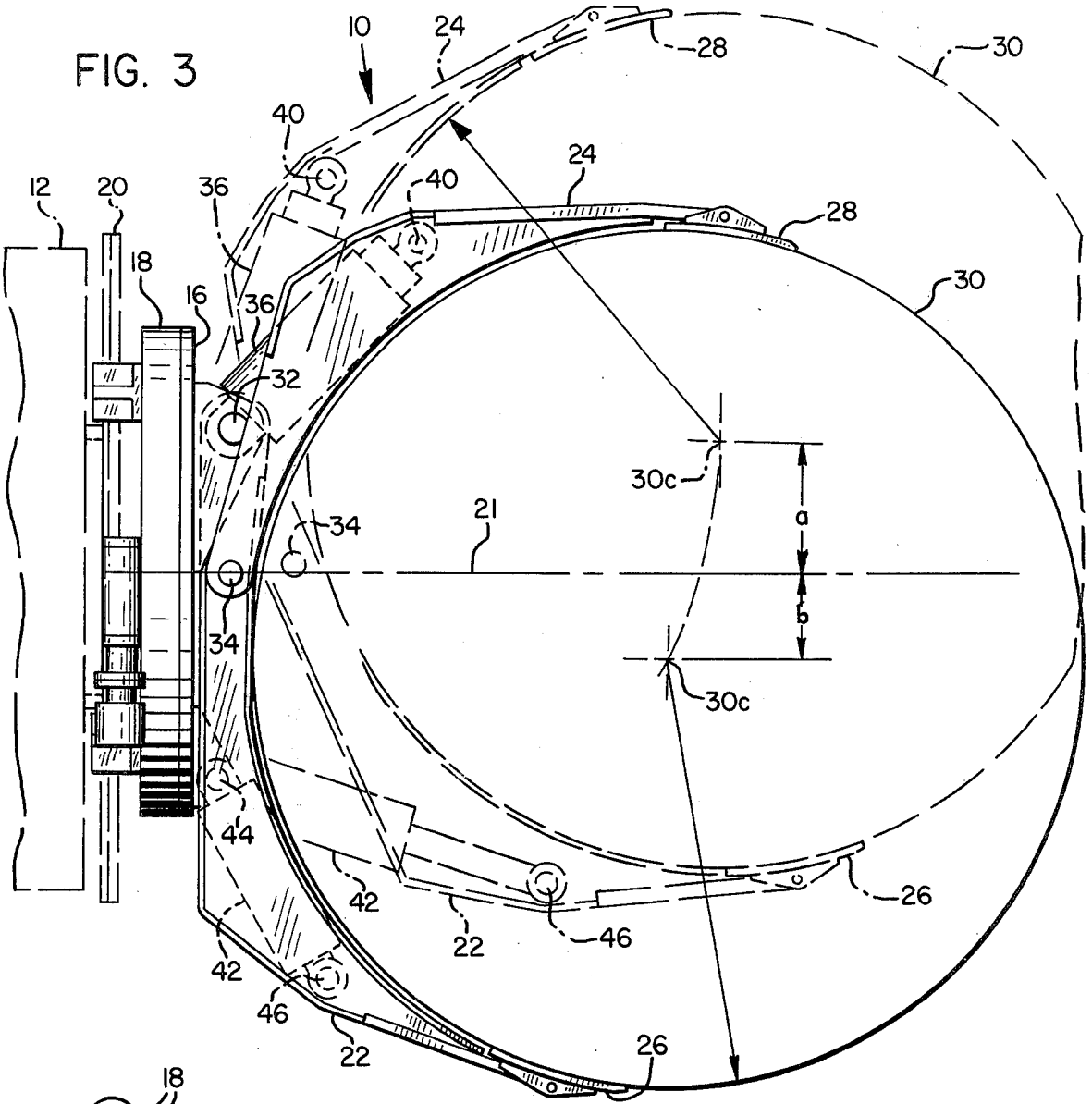
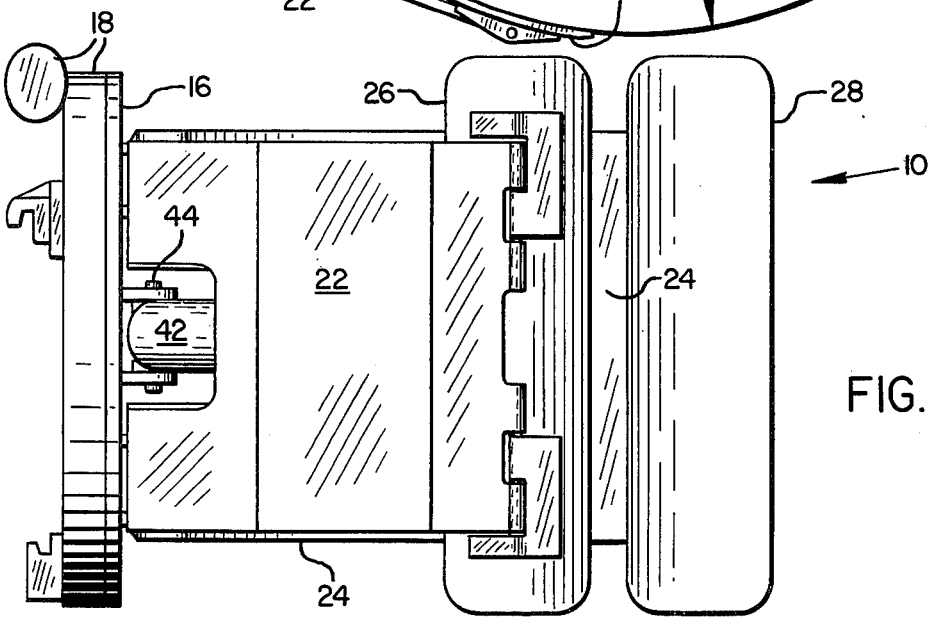
FIG. 4

LIFT TRUCK LOAD CLAMP FOR HANDLING PAPER ROLLS

BACKGROUND OF THE INVENTION

The present invention relates to improvements in lift truck mounted clamping apparatus for picking up, transporting and stacking large rolls of paper such as newsprint and kraft paper. More particularly the invention relates to improvements in the geometry of paper roll-handling clamps of the pivoted arm type capable of performing the three functions of clamping a paper roll, rotating it about an axis longitudinal of the lift truck, and shifting the roll laterally from side-to-side or vertically up and down with respect to the frame by which the clamp is mounted on the lift truck mast.

In the past, it has been recognized that it is advantageous for a lift truck mounted paper roll clamp to be constructed such that the clamp arms are capable of engaging a given paper roll both in a position of equal extension, wherein the forwards ends of the clamp arms on either side of the paper roll extend a substantially equal distance forwardly of the lift truck and, alternatively, in a position of unequal extension wherein the forward end of one clamp arm extends a greater distance forwardly of the lift truck than the forward end of the other. The basic desirability of this feature is discussed, for example, in Quayle U.S. Pat. No. 2,870,929 which explains that when a paper roll is lying in a horizontal position on the floor or ground, the upper clamping arm must overreach the lower clamping arm in order to grasp the roll to pick it up. Thereafter, if the paper roll is to be stacked vertically by rotating the clamp about its axis of rotation, the overreaching which is characteristic of the position of unequal extension becomes an obstacle since both clamp arms should extend the same distance from the truck to place the vertical paper roll in close, compact proximity to other vertical paper rolls. The "unequal extension" position also makes it difficult to remove a vertical paper roll from a compact stack of vertical rolls because of the need to insert the clamp arms between the adjacent rolls. Accordingly, when handling rolls in the vertical position, the position of equal extension of the clamp arms is advantageous.

While Quayle provided a solution to the aforementioned problem by utilizing forward and rearward tilt of the mast of the lift truck in combination with tilt of the clamp frame relative to the mast, it is far more advantageous if such result can be obtained independently of such tilting, and with the use of pivoted rather than sliding clamp arms which are capable of providing a shifting function whereby the roll may be moved laterally from side-to-side or vertically up and down relative to the clamp frame to provide maneuverability of the roll with respect to the frame in tight quarters where maneuverability of the lift truck itself is limited.

Such pivoted shifting function, and the capability for moving the clamp arms to positions of equal and unequal extension respectively, have been provided by other prior art devices including those shown in Sinclair U.S. Pat. No. 3,896,957 and similar older clamps for handling cylindrical objects such as Burton U.S. Pat. No. 3,583,586 and Neale, Sr. U.S. Pat. No. 2,814,396. All of these clamps utilize a pivoted arm construction permitting both the unequal extension and equal extension positions, and also providing the shifting function. Furthermore the Sinclair and Burton patents disclose arrangements whereby the pin about which the two clamp arms pivot in unison to perform the shifting function is offset substantially from the longitudinal centerline of the lift truck and axis of rotation of the clamp. Although Sinclair states that the purpose of this offset location of the pin is to cause a paper roll to be centered with respect to the axis of rotation of the clamp when the clamp arms are in the position of unequal extension, this is actually a disadvantage since the necessary corollary of centering the roll in the unequal extension position of such a clamp is the decentering of the roll in the equal extension position. Such result is a reversal of what is actually desirable because the equal extension position is designed for handling vertically oriented rolls which, if decentered or offset transversely to the longitudinal centerline of the lift truck and rotational axis of the clamp, will always impose a sideways imbalance on both the truck and the clamp rotator mechanism in the equal extension position. The sideways imbalance, particularly when the vertical roll is being handled at a substantial height, can contribute markedly to instability and resultant sideways tipping of the lift truck, and can also place unneeded stress on the rotator mechanism. Accordingly it would be advantageous if the center of the roll were as close as possible to the longitudinal centerline of the lift truck and to the axis of rotation of the clamp when the clamp is in the equal extension position, rather than intentionally decentered by a substantial distance as taught by Sinclair. Conversely, it is advantageous to decenter the roll when the clamp is in the position of unequal extension (also the opposite of Sinclair) because the position of unequal extension is applicable to the horizontal orientation of the roll where the decentering of the roll below the axis of rotation of the clamp would in fact provide a stabilizing "pendant" effect, and where the centering of the roll would provide no particular advantage. Accordingly the decentering of the roll in the position of equal extension of the clamp arms, which in the prior art results from the offset of the pivot point about which the clamp arms move to perform the shifting function, constitutes a disadvantage to be overcome.

Of course one obvious solution would be to eliminate the offset of the pivot point about which the shifting function occurs, as in the Neale patent, making the pivot point coincident with the axis of rotation of the clamp. However the offset of the pivot point does perform a useful function in that it provides a more compact arrangement of the clamp structure, which enhances the loadlifting capacity of the lift truck, while maximizing the range of movement of the shifting function. Accordingly the problem is to maintain the offset position of the pivot point about which the shifting function occurs while at the same time minimizing the decentration of the paper roll when the clamp arms are in the position of equal extension.

SUMMARY OF THE PRESENT INVENTION

The present invention is directed to improvements in lift truck paper roll clamps of the pivoted arm type for the purpose of solving the foregoing problem. As in the prior art, the clamp comprises a pair of selectively openable and closeable opposing clamp arms mounted upon a rotatable frame adapted to rotate about an axis coincident with the longitudinal centerline of the lift truck. However, whereas in the prior art the clamp arms pivot with respect to one another to perform the clamping function about the same pivot axis about which the shifting function occurs, in the present invention the clamping function and shifting function respectively occur about different pivot axes. In the present invention, the pivot axis employed for the shifting function is offset from the longitudinal centerline of the truck and axis of rotation of the clamp. However the separate pivot axis employed for the clamping function is much nearer to the axis of rotation of the clamp so as to overcome the above-mentioned drawback of the offset pivot axis employed for shifting, while preserving its advantages.

More particularly, the paper roll-handling clamp of the present invention comprises a pair of selectively openable and closeable opposing clamp arms mounted upon a frame which in turn is adapted to be rotatably mounted upon the lifting apparatus of a lift truck. The rear end of the first one of the clamp arms is connected to the frame at a first pivotal connection offset from the axis of rotation of the frame for permitting the arm to pivot about a first transverse pivot axis. The rear end of the second clamp arm however, rather than being connected to the same first pivotal connection as in the prior art, is instead connected to a different pivotal connection located a spaced distance away from the first connection at a mid-position on the first clamp arm intermediate the forward and rear ends thereof. Thus a second transverse pivot axis is created, not only spaced from the first pivot axis and much nearer to the axis of rotation of the clamp than the first pivot axis, but also movable with respect to the first pivot axis in response to movement of the first clamp arm.

The clamp arms pivot with respect to one another in the performance of the clamping function about the second pivot axis under the influence of an extensible and retractable piston and cylinder assembly. One end of this piston and cylinder assembly is pivotally interconnected with the first clamp arm at a position adjacent the clamp frame, preferably at the first pivotal connection so as to be pivotal about the first pivot axis, while the other end is connected pivotally to the second clamp arm. The spaced clamping positions of the two clamp arms, determined by their relative pivotal positions with respect to the second pivot axis, are controlled by this piston and cylinder assembly.

Both clamp arms, regardless of their particular clamping position, can be pivoted in unison about the first pivot axis to perform the shifting function while maintaining the particular clamping position. The shifting function is powered by a further piston and cylinder assembly which extends between the frame and the first clamp arm.

The offset position of the first pivot axis about which the shifting function occurs preserves the compactness and optimum range of shifting in either direction which are desirable in a paper roll clamp, while the different position of the second pivot axis, which is nearer to the axis of rotation of the clamp than the first pivot axis, eliminates most of the decentration of the paper roll in the position of equal extension of the clamp arms which would otherwise occur if both the clamping and shifting functions occurred by pivoting about the same offset pivot axis. At the same time the dual, separate pivotal connections enable substantial decentration of the roll toward either side of the clamp rotation axis when the clamp is in the position of unequal extension, which is desirable since such position is applicable to horizontal rolls where such decentration imposes a stabilizing pendant effect on the rotating frame, opposing unwanted tipping of the truck or rotation of the clamp.

In addition the fact that the second pivotal connection and thus the second pivot axis, because they are located at an intermediate position on the first clamp arm, are movable forwardly in response to forward movement of the first clamp arm, provides a more variable clearance between the rear surface of the second clamp arm and the clamp frame than is permitted by the prior art single pivot systems. This feature in turn provides a greater degree of arc for the shifting function over that of the prior art for the same size rolls, and accords a greater range of shifting maneuverability for the lift truck operator.

Another advantage of the present construction is that it requires no rearward extension of any of the piston and cylinder assemblies into the area of the rotating frame where space is limited, which otherwise presents design difficulties. This advantage is primarily a result of the pivotal connection at the first pivot axis of the piston and cylinder assembly employed for the clamping function.

Accordingly, it is a primary objective of the present invention to provide an improved paper roll handling clamp of the pivoted arm type wherein shifting of the clamp arms in unison is performed about a pivot axis offset transversely from the axis of rotation of the clamp, but wherein decentration of the paper roll with respect to the axis of rotation of the clamp is minimized to an amount substantially less than the amount of the offset when the clamp is in the position of equal extension of the clamp arms.

It is a principal feature of the present invention that the shifting function of the clamp arms in unison with respect to the clamp frame is performed about a first pivot axis offset from the axis of rotation of the clamp, while the clamping function wherein the clamp arms pivot with respect to one another is performed about a second pivot axis spaced from the first pivot axis and located nearer to the axis of rotation of the clamp than the first pivot axis.

The foregoing and other objectives, features and advantages of the present invention will be more readily understood upon consideration of the following detailed description of the invention taken in conjunction with the accompanying drawings.

BRIEF DESCRIPTION OF THE DRAWINGS

FIG. 3 is a top view of the clamp showing two extremes of shifting movement with respect to a vertical paper roll of a particular diameter.

FIG. 4 is a side view of the clamp rotated 90° from that shown in FIG. 1.

DETAILED DESCRIPTION OF THE INVENTION

Figure 1:
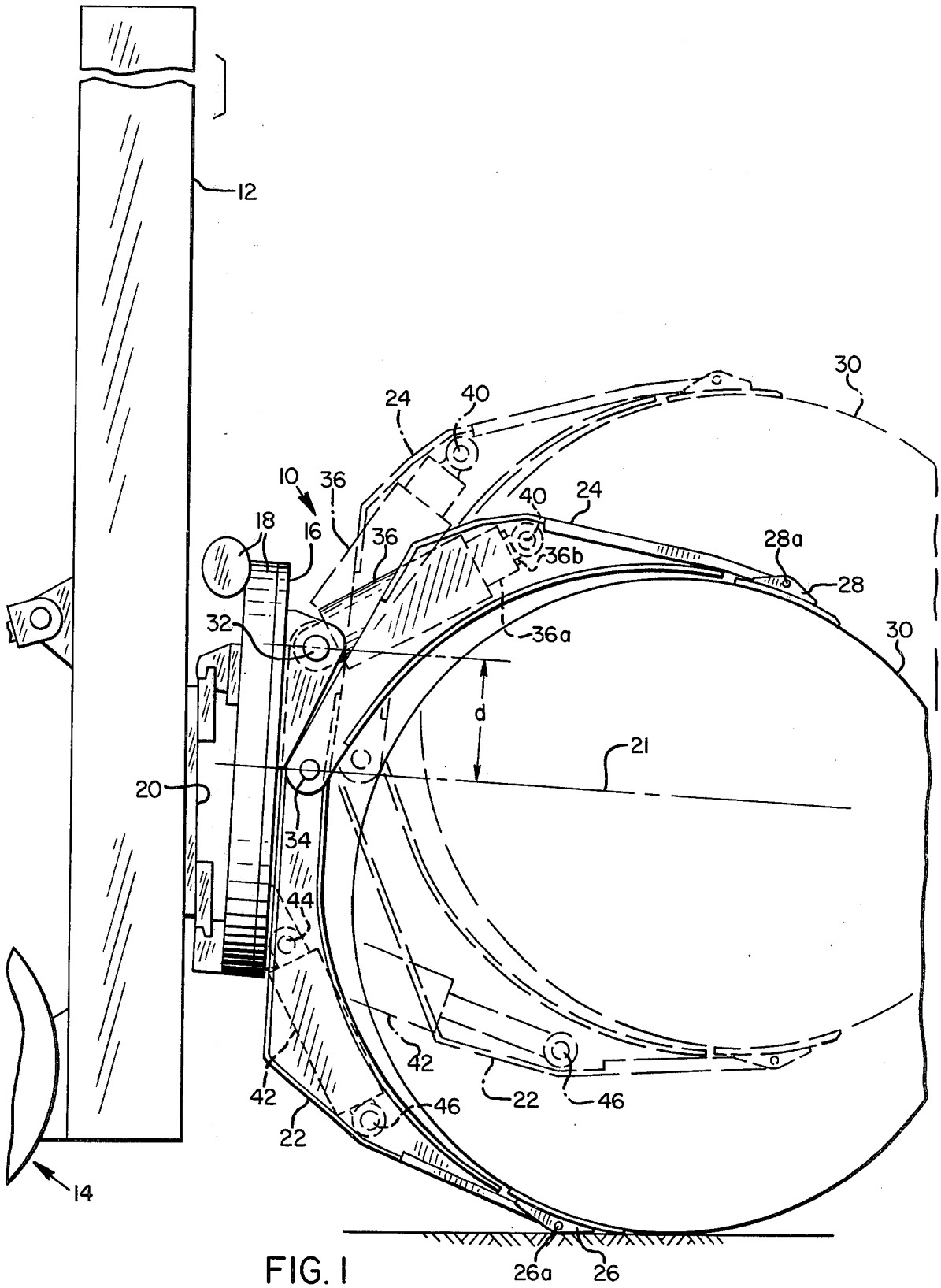
FIG. 1 is a side view of an exemplary embodiment of the paper roll handling clamp of the present invention shown mounted on a lift truck, with the clamp arms in a position of unequal extension clamping a horizontal paper roll.

With reference to FIG. 1, the paper roll-handling clamp attachment designated generally as 10 is mounted on a mast 12 at the forward end of a lift truck 14. The clamp 10 has a frame 16 which is rotatably mounted by means of a rotator 18 upon a carriage 20 which moves vertically selectively upward or downward on the mast 12. The rotator 18 provides powered rotation of the frame 16 about an axis of rotation 21 extending generally forwardly from the mast 12 and carriage 20 along the longitudinal centerline of the lift truck 14.

Mounted upon the frame 16 are a pair of transversely spaced, forwardly projecting selectively openable and closeable opposing clamp arms 22 and 24 respectively. Each such clamp arm is equipped with a paper roll engaging contact pad 26 and 28 respectively defining the forward ends of the respective clamp arms 22 and 24. The contact pads have opposing concave arcuate surfaces for gripping the cylindrical sides of a paper roll such as 30. Each contact pad 26 and 28 is hingedly connected to the remainder of the clamp arm by a respective hinge 26*a* and 28*a*.

The rear end of the clamp arm 22 is pivotally connected to the frame 16 by a pin 32 offset by a distance *d* from the axis of rotation 21, forming a pivotal connection having a first transverse pivot axis at that point. Conversely, the rear end of the other clamp arm 24 is pivotally connected to a mid-portion of the clamp arm 22 by a pin 34 at a position between the two ends of the arm 22 spaced away from the first pin 32 by a distance substantially the same as the offset distance *d*. The pin 34 thus constitutes a second pivotal connection having a second transverse pivot axis connecting the rear end of the arm 24 to the arm 22 at a location nearer to the axis of rotation 21 of the clamp than the first pivot axis.

Figure 5:
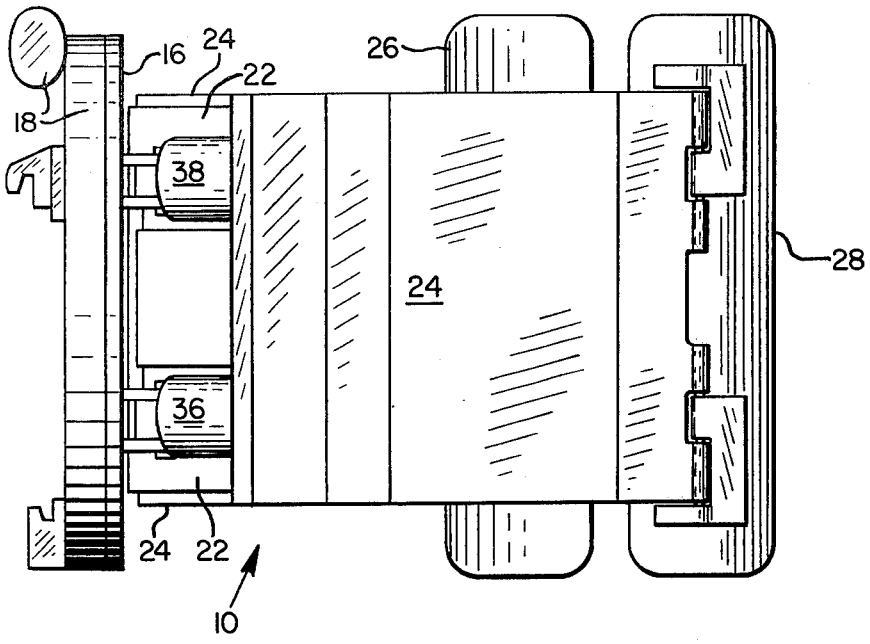
FIG. 5 is a side view of the clamp rotated 180° from that shown in FIG. 4.

To perform the clamping function, the two clamp arms 22 and 24 are movable relative to one another for grasping and releasing paper rolls of varying diameter by the pivoting of clamp arm 24 with respect to clamp arm 22 about the pivot pin 34. Power for such relative clamping movement is furnished by a pair of double stage, selectively extensible and retractible piston and cylinder assemblies 36 and 38 respectively (FIGS. 1 and 5). The piston and cylinder assemblies 36 and 38 are pivotally interconnected at one end thereof with the clamp arm 22 at a location adjacent the frame 16, preferably by the pivot pin 32 so as to pivot relative to the frame about the same pivot axis as the clamp arm 22. The forward ends of the piston and cyinder assemblies 36 and 38 are pivotally connected to a mid-portion of the clamp arm 24 by a pin such as 40. It will thus be seen that the connection of the piston and cylinder assemblies 36 and 38 forms a triangle having corners defined by the pins 32, 34 and 40 respectively, the leg of the triangle between pins 32 and 40 represented by the piston and cylinder assemblies 36 and 38 being of variable length and thereby determining the pivotal position of the clamp arm 24 relative to the clamp arm 22, which in turn determines the distance between the forward ends of the respective clamp arms. Accordingly, extension of the piston and cylinder assemblies 36 and 38 tends to draw the forward ends of the clamp arms together for clamping a paper roll of any given diameter, while retraction of the assemblies 36 and 38 spreads the clamp arms and releases the roll.

A single piston and cylinder assembly 42, selectively extensible and retractible independently of the piston and cylinder assemblies 36 and 38, is pivotally connected by a pin 44 to the frame 16 and by a pin 46 to a mid-portion of the clamp arm 22. Extension and retraction of the piston and cylinder assembly 42 pivots the clamp arm 22 respectively forwardly and rearwardly about the pivot pin 32 to enable the clamp arm 22 to assume various positions, such as the position shown in dotted lines in FIG. 1.

It will be appreciated that, since the piston and cylinder assemblies 36 and 38 when not actuated define a rigid connection between the clamp arm 24 and the clamp arm 22 (defined by the triangle having the pins 32, 34 and 40 at its corners), movement of the clamp arm 22 in response to extension or retraction of the piston and cylinder assembly 42 about the pin 32 causes a corresponding movement of the clamp arm 24, such that the distance between the forward ends of the two clamp arms remains constant. Thus the clamp arms 22 and 24 may be shifted in unison about the pivot pin 32 despite the fact that the clamp arms pivot with respect to one another about a differently located pivot pin 34.

The pivotal interconnection of the rear ends of the piston and cylinder assemblies 36 and 38 respectively with the clamp arm 22 enables the shifting function of the clamp arms in unison because the triangle 32, 34, 40 is left undisturbed by the pivotal movement of the clamp arm 22. A similar result could be obtained if the rear ends of the piston and cylinder assemblies 36 and 38 were pivotally mounted directly to some portion of the clamp arm 22 at a location adjacent the frame 16 other than the pin 32 such that the pivotal connection would move with the arm 22; however use of the pivot pin 32 about which the clamp arm 22 pivots is preferable because of simplicity and economy.

It is notable that the rear pivotal connection of the piston and cylinder assemblies 36 and 38 which power the clamping function need not in any case be located rearwardly of the pivot pin 32 or frame 16, which would otherwise place the pivotal connection in the area of the rotator 18 causing design problems because of the lack of available space. The double-stage construction of the piston and cylinder assemblies 36 and 38, whereby each assembly has a pair of telescoping pistons such as 36*a* and 36*b* (FIG. 1) within the cylinder, helps to attain this objective by providing substantial extensibility while collapsing to an exceptionally compact size which minimizes the distance which must be provided between the pins 32 and 40 when the clamp arms are at their positions of maximum spread.

Figure 2:
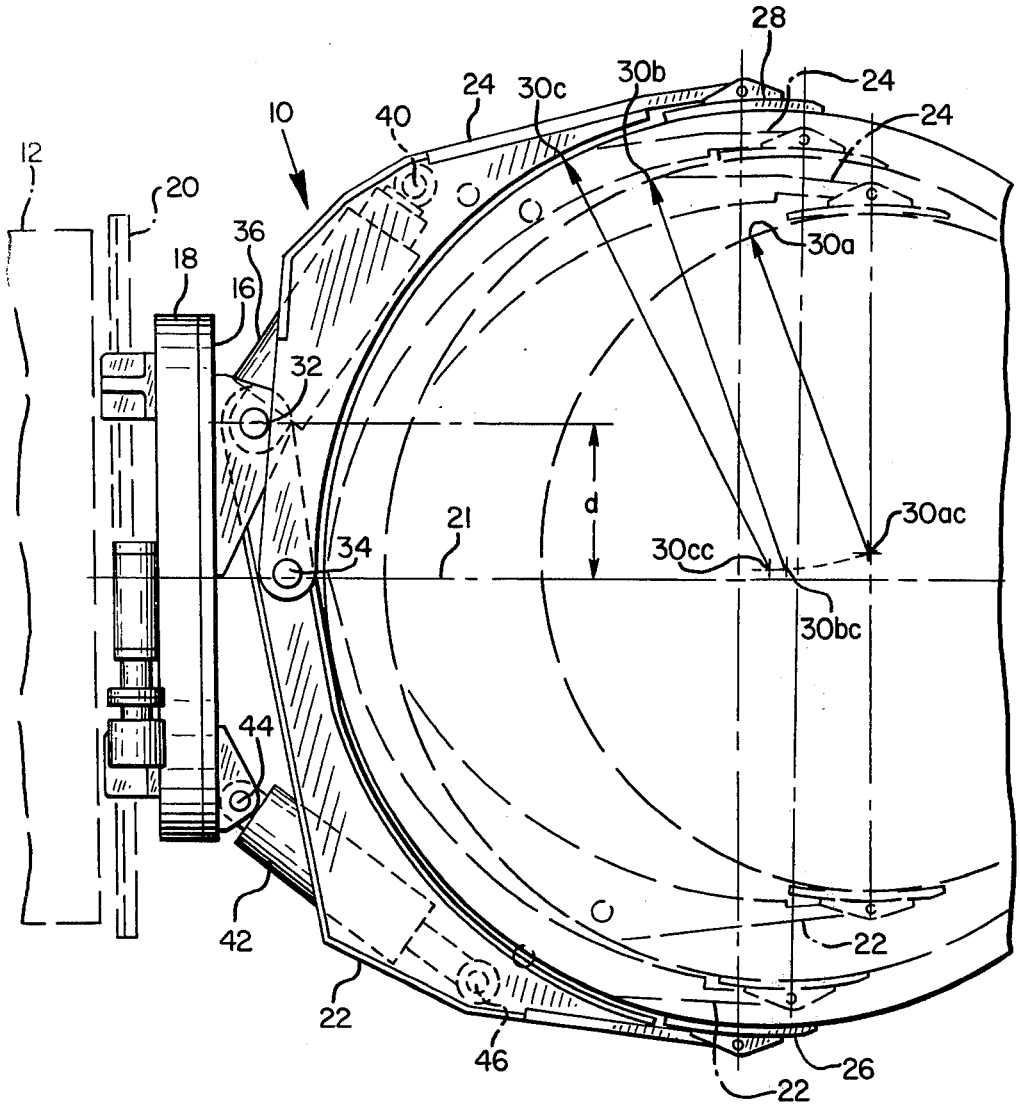
FIG. 2 is a top view of the clamp rotated 90° from the position of FIG. 1 to a position for handling vertical rolls, showing various positions of equal extension of the clamp arms with respect to vertical paper rolls of differing diameters.
Figure 6:
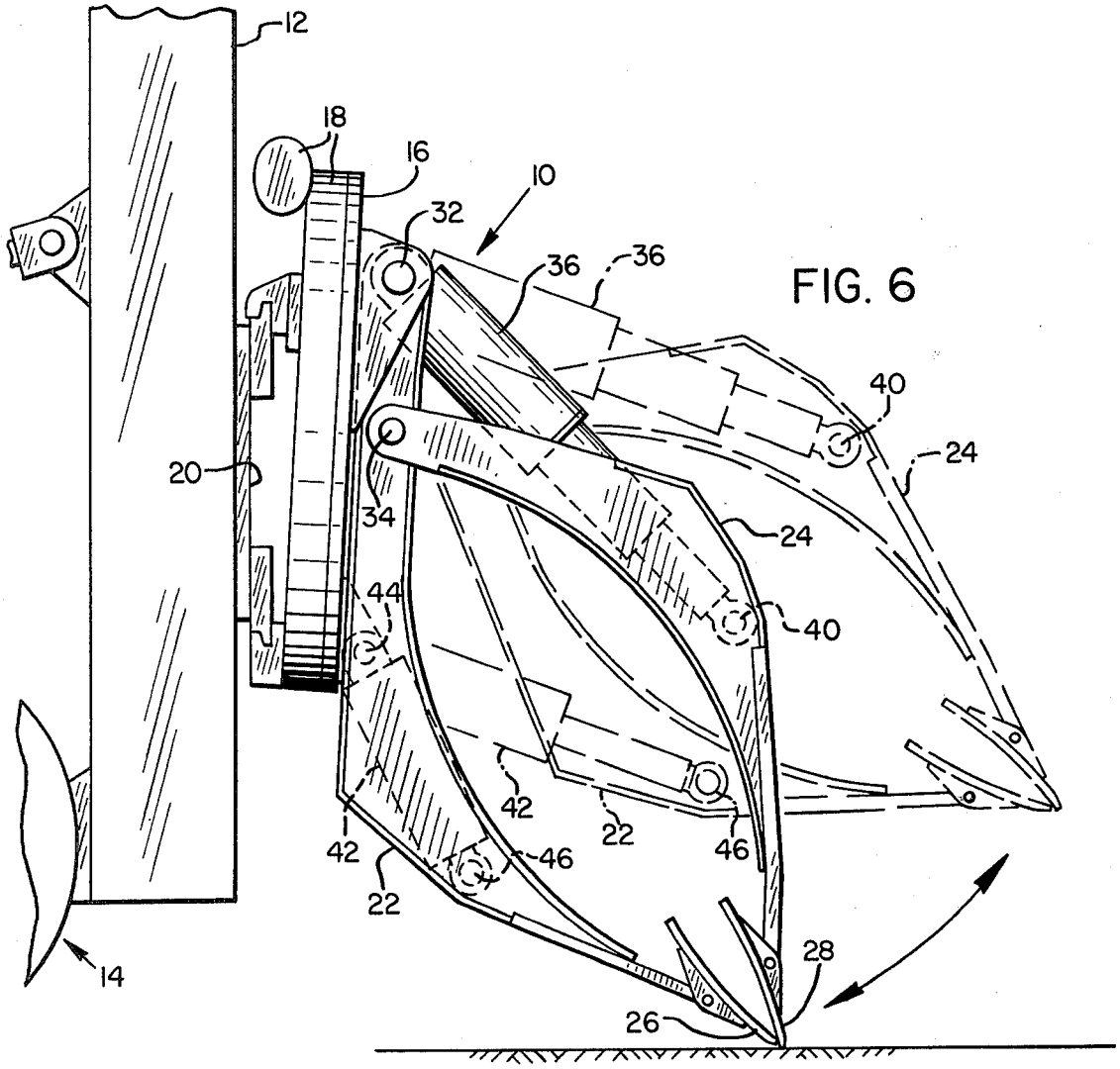
FIG. 6 is a side view of the clamp showing the clamp arms in a completely closed position.

The operational benefits of the foregoing structural arrangement can be seen from FIGS. 2, 3 and 6. FIG. 2 shows various positions of equal extension of the clamp arms 22 and 24 with respect to paper rolls 30*a*, 30*b* and 30*c* respectively of differing diameters. Each of these positions of equal extension, wherein the forward end of each clamp arm 22 and 24 extends substantially the same distance forwardly of the clamp frame 16, is achieved by appropriate actuation of the piston and cylinder assemblies 36 and 38 combined with the actuation of the piston and cylinder assembly 42, the assemblies 36 and 38 serving to adjust the distance between the forward ends of the clamp arms to correspond to the diameter of a particular roll and the assembly 42 serving to move the pair of clamp arms in unison to a position where equal extension is achieved. However, whereas in prior single-pivot point systems equal extension is achieved with the center of the paper rolls (corresponding to the midpoint of the distances between the forward ends of the clamp arms) offset from the axis of rotation 21 by the same distance (such as *d*) by which the shifting pivot axis is offset from the axis of rotation, in the present invention the centers 30*ac*, 30*bc* and 30*cc* respectively of the rolls 30*a*, 30*b* and 30*c* are much nearer to the axis of rotation 21 of the clamp than the shifting pivot axis defined by the pin 32. In fact the centers of the rolls of varying diameter at the equal extension positions of the present clamp are nearly coincident with the axis of rotation 21, and thus with the longitudinal centerline of the lift truck. Accordingly vertically oriented rolls of differing diameter impose negligible sideways imbalance, in the equal extension position, upon the lift truck 14 and rotator 18 as a result of the utilization of a pivot axis, corresponding to the pin 34, for the clamping function which is nearer to the axis of rotation 21 than the pivot axis corresponding to the pin 32, utilized for the shifting function.

The shifting function is illustrated with particular clarity in FIG. 3 wherein the two extremes of shifting motion are illustrated with respect to a particular roll 30 of predetermined diameter. One of the points evident from this figure is that the center 30*c* of the roll 30 at the two extreme shifting positions shown, which are also positions of unequal extension of the clamp arms, are substantially offset or decentered, by distances *a* and *b* respectively, on either side of the axis of rotation 21 of the clamp. This substantial decentration of the rolls in unequal extension positions of the clamp arms is the corrollary of the centering of the rolls with respect to the clamp axis of rotation in the positions of equal extension, and is advantageous in the handling of horizontally oriented rolls, for which the positions of unequal extension are primarily used, to provide the stabilizing "pendant" effect whereby the center of mass of the roll hangs below the axis of rotation 21. It is also noteworthy that the decentration distances *a* and *b*, at the two extremes of shifting motion, are of similar length on either side of the clamp axis of rotation 21, with no great discrepancy between the extent of shifting to one side and the extent of shifting to the other. This feature, which provides the lift truck operator with maximum lateral maneuverability of vertical rolls to either side of the lift truck longitudinal centerline without movement of the truck, is to be contrasted with single-pivot systems wherein the offset position of the single pivot enables the clamp to shift a vertical roll a great distance from the axis of rotation and longitudinal centerline of the truck in the direction of the offset, but a much smaller distance in the opposite direction thereby severely hampering the versatility of the shifting feature.

FIG. 3 also illustrates the fact that the axis of the pivot pin 34, while movable outwardly about the pin 32, is always separated from the forwardly facing surfaces of the frame 16 by a distance less than the offset *d* of the pin 32, and less than the center-to-center distance separating the pins 32 and 34. The closeness of the pin 34, in all operative positions of the clamp arms, to the frame 16 and thus to the axis of the front wheels of the lift truck is important in that it minimizes the forwardly extending distance to the center of the load and thereby maximizes the weight-carrying capacity of the counterbalanced lift truck 14.

A further function of the clamp of the present invention is illustrated in FIG. 6 wherein the substantially complete closeability of the clamp arms and their ability to be shifted in unison in such closed position is illustrated. Such completely closed position is useful for such jobs as picking up large end scrap pieces of paper from paper rolls, which are characteristically discarded in heaps on the floor by the user of the rolls. Such scraps pieces are quite bulky and difficult to handle manually, and it is therefore advantageous that paper roll clamps have such capability for complete closure. It will be noted that such capability requires that the length of the clamp arms, between their forward ends and the point about which they pivot with respect to one another to perform the clamping function, such as pin 34, must be substantially equal.

The terms and expressions which have been employed in the foregoing abstract and specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A load-handling clamp adapted to be mounted upon the lifting apparatus at the forward end of a lift truck for engaging a cylindrical roll of paper and the like, comprising:

(a) a frame adapted to be mounted upon said lifting apparatus so as to be selectively movable vertically by said lifting apparatus;

(b) rotating means for rotating said frame with respect to said lifting apparatus about a generally forwardly extending axis of rotation;

(c) first and second selectively openable and closeable opposing clamp arms mounted upon said frame projecting therefrom in a forward direction, each of said pair of clamp arms having a forward end and a rear end respectively;

(d) first pivotal connection means connecting the rear end of the first clamp arm to said frame at a first position for permitting said first clamp arm to pivot with respect to said frame about a first pivot axis extending transverse to said forward direction at said first position;

(e) second pivotal connection means, located at a second position a spaced distance away from said first position on a mid-portion of said first clamp arm between the forward and rear ends thereof, connecting the rear end of the second clamp arm to said first clamp arm for permitting said second clamp arm to pivot with respect to said first clamp arm about a second pivot axis extending transverse to said forward direction at said second position;

(f) power means mounted upon said frame and connected to said respective clamp arms for selectively moving said clamp arms in unison about said first pivot axis and pivoting said clamp arms with respect to one another about said second pivot axis;

(g) said first pivot axis being offset transversely from said axis of rotation by a distance, and said second pivot axis being nearer to said axis of rotation than said first pivot axis.

2. The apparatus of claim 1 wherein said power means includes a selectively extensible and retractible piston and cylinder assembly pivotally interconnected at one end with said first clamp arm and pivotally connected at the other end to said second clamp arm for pivoting said clamp arms with respect to one another about said second pivot axis.

3. The apparatus of claim 1 wherein said spaced distance between said first and second pivotal connection means respectively is substantially equal to the distance by which said first pivot axis is offset from said axis of rotation.

4. A load-handling clamp adapted to be mounted upon the lifting apparatus at the forward end of a lift truck for engaging a cylindrical roll of paper and the like, comprising:

(a) a frame adapted to be mounted upon said lifting apparatus so as to be selectively movable vertically by said lifting apparatus;

(b) rotating means for rotating said frame with respect to said lifting apparatus about a generally forwardly extending axis of rotation;

(c) a pair of selectively openable and closeable opposing clamp arms mounted upon said frame projecting therefrom in a forward direction, each of said pair of clamp arms having a forward end and a rear end respectively; and (d) powered mounting means movably connecting said clamp arms to one another and to said frame for moving said clamp arms in unison about a first pivot axis transverse to said forward direction and offset transversely from said axis of rotation selectively between a position of equal extension, wherein the forward ends of said clamp arms are spaced apart from one another by a predetermined distance and extend a substantially equal distance forwardly of said frame, and a position of unequal extension, wherein the forward ends of said clamp arms are spaced apart from one another by said predetermined distance and the forward end of one clamp arm extends a greater distance forwardly of said frame than the forward end of the other clamp arm, said powered mounting means including means for causing the midpoint of said predetermined distance between the forward ends of said clamp arms in said position of equal extension to be nearer to said axis of rotation than said first pivot axis.

5. The apparatus of claim 4 wherein said powered mounting means further includes means for moving said clamp arms with respect to one another about a second pivot axis a spaced distance away from said first pivot axis and nearer to said axis of rotation than said first pivot axis.

6. A load-handling clamp adapted to be mounted upon the lifting apparatus at the forward end of a lift truck for engaging a cylindrical roll of paper and the like, comprising:

(a) a frame adapted to be mounted upon said lifting apparatus so as to be selectively movable vertically by said lifting apparatus;

(b) first and second selectively openable and closeable opposing clamp arms mounted upon said frame projecting therefrom in a forward direction, each of said pair of clamp arms having a forward end and a rear end respectively;

(c) first pivotal connection means connecting the rear end of the first clamp arm to said frame at a first position for permitting said first clamp arm to pivot with respect to said frame about a first pivot axis extending transverse to said forward direction at said first position;

(d) second pivotal connection means, located at a second position a spaced distance away from said first position on a mid-portion of said first clamp arm between the forward and rear ends thereof, connecting the rear end of the second clamp arm to said first clamp arm for permitting said second clamp arm to pivot with respect to said first clamp arm about a second pivot axis extending transverse to said forward direction at said second position; and (e) power means mounted upon said frame and connected to said respective clamp arms for selectively moving said clamp arms in unison about said first pivot axis and pivoting said clamp arms with respect to one another about said second pivot axis, said power means including a selectively extensible and retractible piston and cylinder assembly pivotally interconnected at one end with said first clamp arm at a location adjacent said frame and pivotally connected at the other end to said second clamp arm for pivoting said clamp arms with respect to one another about said second pivot axis.

7. The apparatus of claim 6 wherein said piston and cylinder assembly is pivotally interconnected with said first clamp arm at said first position so as to pivot with respect to said first clamp arm about said first pivot axis.

8. The apparatus of claim 6 wherein said piston and cylinder assembly is pivotally interconnected with said first clamp arm at a position so as to pivot with respect to said first clamp arm about a pivot axis located no more rearwardly than said first pivot axis.

9. The apparatus of claim 8 wherein said piston and cylinder assembly is of the double-stage type having two telescoping pistons within a cylinder.

10. The apparatus of claim 6 wherein the distances between said second pivotal connection means and the respective forward ends of said first and second clamp arms are substantially equal.

11. The apparatus of claim 6 wherein said second pivotal connection means is located forwardly of said frame and spaced therefrom at all operative positions of said clamp arms by a distance less than said spaced distance between the positions of said first and second pivotal connection means respectively.

* * * * *